United States Patent [19]

House et al.

[11] Patent Number: 4,480,377

[45] Date of Patent: Nov. 6, 1984

[54] METHOD OF MAKING AN IGNITION COIL CORE

[75] Inventors: Ronnalee House; Roger W. Kellams, both of Anderson, Ind.

[73] Assignee: General Motors Corporation, Detroit, Mich.

[21] Appl. No.: 424,465

[22] Filed: Sep. 27, 1982

[51] Int. Cl.[3] ..... H01F 41/02; H01F 27/26

[52] U.S. Cl. ..... 29/593; 29/606; 29/609; 336/178; 336/210; 336/216

[58] Field of Search ..... 336/216, 178, 134, 210, 336/165; 29/606, 607, 608, 609, 593

[56] References Cited

U.S. PATENT DOCUMENTS

| | | | |
|---|---|---|---|
| 1,748,993 | 3/1930 | Purdy | 336/134 X |
| 1,841,685 | 1/1932 | Sola | 336/216 X |
| 2,220,126 | 11/1940 | Six et al. | 336/134 X |
| 2,439,277 | 4/1948 | Walker | 336/134 |
| 2,712,084 | 6/1955 | Bridenbaugh | 336/216 X |
| 3,209,294 | 9/1965 | Cornell | 336/134 |
| 3,522,569 | 8/1970 | Oechsle | 336/165 |

FOREIGN PATENT DOCUMENTS

| | | | |
|---|---|---|---|
| 231240 | 10/1959 | Australia | 336/216 |
| 42898 | 1/1982 | European Pat. Off. | 336/178 |
| 2950727 | 6/1981 | Fed. Rep. of Germany | 336/178 |
| 3030641 | 4/1982 | Fed. Rep. of Germany | 336/216 |
| 1558102 | 2/1969 | France | 336/216 |

*Primary Examiner*—Thomas J. Kozma
*Attorney, Agent, or Firm*—Robert M. Sigler

[57] ABSTRACT

A laminated core for an ignition coil is made from E shaped and bar shaped laminated members. The E shaped member has equal length outer legs and a shorter center leg with oblique surfaces on the inner free ends of the outer legs. The bar shaped member has oblique surfaces at the ends thereof adapted to engage the oblique surfaces of the first member when the second member is oriented perpendicularly to the center leg of the first member and further to bend the outer legs of the first member outward to generate a restoring spring force as the second member is advanced toward the center leg to reduce the air gap. A coil assembled on the center leg is used to monitor a physical parameter indicative of a desired magnetic or electrical characteristic as the air gap is reduced and the members are fixed together when said characteristic is obtained. The angles formed by the oblique surfaces of the first member with a surface of the center leg are smaller before assembly and no greater after assembly than corresponding angles of the corresponding oblique surfaces of the second member.

2 Claims, 3 Drawing Figures

METHOD OF MAKING AN IGNITION COIL CORE

BACKGROUND OF THE INVENTION

This invention relates to a method for making a laminated core of an ignition coil for use in the spark ignition system of an internal combustion engine. A preferred form for such a core is a stack of laminations in a generally rectangular ring having a central leg extending from one side of said ring across the central opening thereof to the other side and also including an air gap. The primary and secondary windings of the ignition coil are wound on the central leg with the remainder of the coil providing a return flux path to complete the magnetic circuit.

Such a core is generally manufactured by stacking laminations into two parts: the first part in the shape of an E with central and outer legs and the second part in the shape of an E with shorter legs or in the shape of a bar capable of spanning or just fitting within the outer legs of the first piece. The manufacture of the core in two pieces simplifies the assembly process by allowing prewound and formed coils to be dropped over the center leg before the two pieces are joined together. However, it still does not completely solve the problem of controlling the size of the air gap in the assembled ignition coil to produce a coil with predetermined magnetic and electrical performance. In normal assembly, it is found that a certain proportion of ignition coils do not have performance properties within acceptable limits. It is desirable, therefore, to be able to adjust the air gap during the final assembly of the core while the performance properties may be measured by means of the ignition coil windings. Not only is the final air gap controllable at this time, but the adjustment of this air gap while measuring a variable such as inductance automatically corrects for variations in other variables affecting the magnetic properties of the ignition coil.

In the case of two E shaped members which are clamped or welded together during final assembly the total effective air gap is not generally adjustable but is determined by the precise physical characteristics of the members, with air gap contributions from the joints at the outer legs to imperfections in the surfaces caused by variations in the individual lamina. The same is true of a bar shaped piece placed against the end of an E shaped piece and contacting the ends of the outer legs. If a bar shaped piece is made to insert between the ends of the outer legs of an E shaped piece some adjustability is possible. However, if a very tight fit is obtained, the pieces are difficult to assemble and adjust, whereas a loose fit creates structural weakness in the assembled core and control problems due to large and possibly variable air gaps at the ends of the bar shaped piece.

SUMMARY OF THE INVENTION

It is an object of this invention to provide a method of making an ignition coil core in which the air gap of said core may be simply adjusted and permanently fixed during final assembly thereof while monitoring a parameter indicating the magnetic and electrical performance of the coil.

It is another object of this invention to provide such a method providing for easy assembly and suited to automated high volume mass production.

These and other objects are obtained by an ignition coil core having first and second laminated members. The first laminated member has an E shape with equal length outer legs having oblique surfaces on the inner free end thereof and a shorter center leg. The second laminated member has a bar shape with oblique faces at each end thereof corresponding to the oblique faces of the outer legs of the first laminated member when oriented perpendicularly to the center leg thereof. The oblique faces of the second laminated member form angles with respect to the center leg of the first laminated member which are greater before final assembly and at least as great after final assembly as the corresponding angles of the oblique faces of the first laminated member. In assembly, the second laminated member is advanced toward the center leg of the first laminated member with the oblique faces cooperating to bend the outer legs of the first laminated member slightly outward away from the center leg to generate a spring-like restoring force to stabilize the relative positions of the members and the properties of the core are monitored by means of the ignition coil; and advancement of the second laminated member is halted and the two members welded together when such properties are within the desired limits. The difference in the angles of the oblique faces of the two laminated members before assembly are sufficiently great that, in the assembled core, the angles formed by the oblique faces of the second laminated member are still at least as great as those of the first laminated member.

Further details and advantages of this invention will be apparent from the accompanying drawings and following description of a preferred embodiment.

DESCRIPTION OF THE PREFERRED EMBODIMENT

Figure 1:
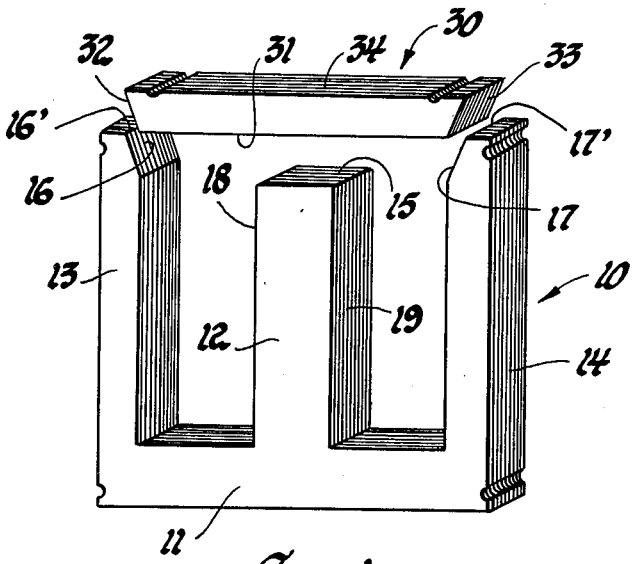
FIG. 1 is a perspective view of the two members from which a core is assembled by the method of this invention.

Referring to FIG. 1, first and second laminated members 10 and 30 may be made, for example, of multiple laminated layers of 0.010 inch thick M-3 grain oriented, electrical steel with a C-5 core plate, although similar materials are acceptable. First laminated member 10 has an E shape with a base 11, a central leg 12 projecting perpendicularly from the center of base 11, and a pair of outer legs 13 and 14 extending from the opposite ends of base 11 in the same direction of center leg 12 and parallel thereto with first laminated member 10 in the unassembled state. Center leg 12 is shorter than the equal length outer legs 13 and 14 and has a flat end surface 15 which is perpendicular to an imaginary axis running straight through the center of the center leg 12 perpendicular to base 11.

Each of the outer legs 13 and 14 is provided, on its inner free end facing center leg 12, with an oblique surface, which oblique surfaces are number 16 and 17 for legs 13 and 14, respectively, in FIG. 1. These oblique surfaces 16 and 17 form identical angles of 29°, when first laminated member 10 is in its unassembled state, with the planes of the inner sides 18 and 19 of center leg 12 which are themselves parallel with the imaginary axis through the center of center leg 12.

Second laminated member 30 is in the shape of a bar and is shown in FIG. 1 as being oriented perpendicularly to the imaginary axis through the center of center leg 12 of first laminated member 10. Second laminated member 30 has a lower surface 31 which, in the previously described orientation, is parallel with end surface 15 of center leg 12 of first laminated member 10. Second laminated member 30 further has, at the ends thereof, oblique surfaces 32 and 33 adjacent the oblique surfaces 16 and 17, respectively, of first laminated member 10. The length of second laminated member 30 is greater at the upper surface 34 thereof than the distance between the upper edges 16' and 17' of oblique surfaces 16 and 17; but its length at the lower surface 31 is less than the distance between edges 16' and 17'. Oblique surfaces 32 and 33 form identical angles of 30° with the planes of surfaces 18 and 19 of center leg 12 of first laminated member 10. Therefore, if second laminated member 30 is advanced toward the center leg 12 of first laminated member 10 with its perpendicular orientation retained, edges 16' and 17' of the outer legs 13 and 14, respectively, of first laminated member 10 will eventually engage oblique surfaces 32 and 33 of second laminated member 30. Additional movement of the second laminated member 30 toward the center leg 12 of first laminated member 10 can only be accomplished against the spring force of the outer legs 13 and 14 of first laminated member 10 as they are bent outward by the oblique surfaces 32 and 33 of the advancing second laminated member 30. Since the outer legs 13 and 14 are being bent outward, the angles formed by oblique surfaces 16 and 17 with the sides 18 and 19 of center leg 12 increase until, when said angles reach 30°, oblique surfaces 16 and 17 become flush with oblique surfaces 32 and 33, respectively.

At this point there is a minimal air gap between the ends of second laminated member 30 and the outer legs 13 and 14 of first laminated member 10. The main air gap is that between surface 15 of center leg 12 of first laminated member 10 and the lower surface 31 of second laminated member 30. The dimensions of the first and second laminated members 10 and 30 are such that the total air gap at this point is no greater than the desired air gap for the assembled core. Thus, as second laminated member 30 is advanced toward the center leg 12 of first laminated member 10 in the manner described above, the desired air gap will be reached at or before the point at which the air gaps between second laminated member 30 and the outer legs 13 and 14 of first laminated member 10 reach their minimum values.

Figure 3:
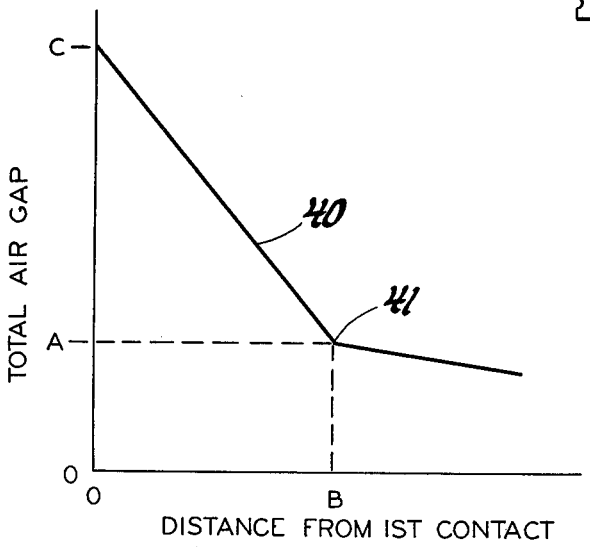
FIG. 3 is a curve of total effective air gap versus distance from first contact as the members in FIG. 1 are moved together during the method of this invention.

Since the total effective air gap of the core is affected by all air gaps in the magnetic circuit, the effect on the total effective air gap of the advancement of second laminated member 30 toward the center leg 12 of first laminated member 10 can be seen in the graph of FIG. 3. In this somewhat idealized graph, the total air gap is measured along the vertical axis from the origin; whereas the distance moved by second laminated member 30 from the first contact with the outer legs 13 and 14 of first laminated member 10 is measured along the horizontal axis. Curve 40 represents the variation in the total effective air gap (or another variable proportional thereto), which assumes the value C at the point of first contact, as seen at the intersection of curve 40 with the vertical axis. As second laminated member 30 is advanced from this point of first contact, there is a consistent reduction of the air gaps between second laminated member 30 and the outer legs of first laminated member 10 as well as that between second laminated member 30 and the center leg 12 of first laminated member 10. This causes a consistent, smooth reduction in the total air gap until the oblique surfaces 32 and 33 become flush with oblique surfaces 16 and 17, respectively, and the air gaps between the second laminated member 30 and the outer legs 13 and 14 of first laminated member 10 reach their minimum values. This is represented in the graph by point 41, with a total effective air gap A and a distance from first contact B. Further advancement of second laminated member 30 toward the center leg 12 of first laminated member 10 from this point will cause an increase in the air gaps between second laminated member 30 and the outer legs 13 and 14 of first laminated member 10 to be combined with the further decrease in the air gap between the second laminated member 30 and center leg 12 of first laminated member 10. This results in an abrupt discontinuity in curve 40 as seen in FIG. 3. To avoid this discontinuity and preserve the smooth change of the total effective air gap during the assembly process, the parts are designed with dimensions such that the desired total effective air gap is less than C and no less than A. Thus the desired total effective air gap will be attained while on the smooth continuous part of curve 40 up to or possibly including point 41. This simplifies the required control algorithms automatic control of the assembly process.

Figure 2:
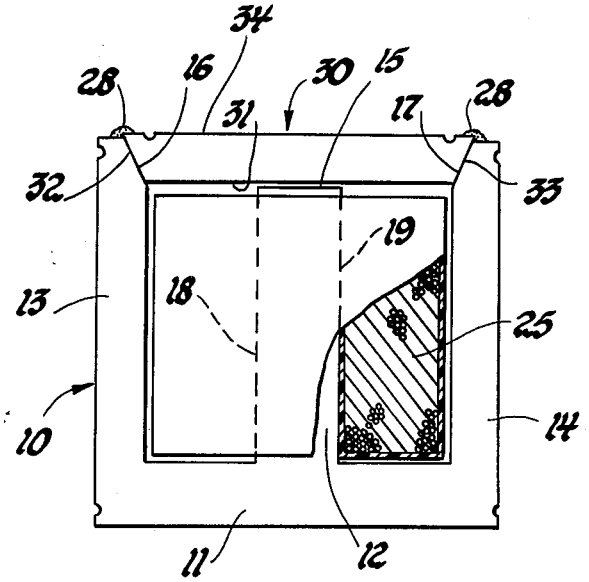
FIG. 2 is a partially cut-away side view of an ignition coil including a core assembled by the method of this invention.

The process of assembly of the core is described below. First the assembled coil is wound or placed around the center leg 12 of first laminated member 10 with appropriate insulators and other parts as shown in FIG. 2. This coil is shown only in representative form in FIG. 2, since it actually comprises a pair of coil windings forming a transformer with an annularly large secondary coil of many turns surrounding an annularly thin primary coil of a much smaller number of turns as is well known in the art of ignition coils. In any event, the precise structure and composition of the coil or transformer 25 is irrelevant to this invention as long as it is in place around center leg 12.

Whatever the form of coil or transformer 25, once it is in place the inductance of the core may be measured by the application of current to one of the windings. Since the inductance varies with the total effective air gap, this total effective air gap can be effectively monitored during the final assembly process.

While the total effective air gap is being monitored, second laminated member 30 is oriented perpendicularly to the center leg 12 of first laminated member 10 as shown in FIG. 1 as described above and advanced as previously described until the monitored total effective air gap reaches the desired value. The first laminated member 10 may be held stationary in a proper fixture while the second laminated member 30 is advanced against the increasing spring force generated by the outwardly bent outer legs 13 and 14 of first laminated member 10. This increasing spring force contributes to the smoothness of operation of the assembling fixture, since it takes up any possible free play or slack in the mechanism and helps stabilize the members. When the desired total effective air gap is obtained, the second laminated member may be welded across the full width thereof at each end to the adjacent outer leg of the first laminated member, as shown at reference numeral 28, with a tungsten inert gas welding electrode. As a practical matter, to allow for some springback in the completed and welded assembly due to the spring force of outer legs 13 and 14 of first laminated member 10, it may be necessary to advance the second laminated member 30 a predetermined distance past the point of desired total effective air gap before welding takes places so that the desired total effective air gap will be obtained by the finished assembly after springback. If this is the case, other statements in this specification and the following claims should be modified where appropriate in accordance therewith in the manner known to those skilled in the art.

The assembly of the core while varying the air gap and monitoring the inductance of the core and winding permits the magnetic and electrical characteristics of the ignition coil to be determined during this final assembly and thus reduces scrappage, regardless of dimensional and material variations in the various parts of the assembly. The oblique surfaces of the laminated members facilitate the easy fitting together of the parts and enable the spring force of the outer legs of the E shaped laminated member to help stabilize the members and ensure good physical engagement of the members for minimal secondary air gaps and a strong, stable final assembly. Variations from the structure and method shown and described herein will occur to those skilled in the art; therefore this invention should be limited only by the claims which follow.

The embodiments of the invention in which an exclusive property or privilege is claimed are defined as follows:

1. A method of making a laminated core for an ignition coil with an air gap from first and second laminated members, the first laminated member having an E shape with a pair of resiliently bendable outer legs and a shorter center leg and oblique surfaces on the inner free ends of the outer legs forming equal angles with a surface of the center leg, the second laminated member having a bar shape with oblique surfaces at the ends thereof forming equal angles with said surface of the center leg greater than the corresponding angles of the oblique surfaces of the first laminated member when the second laminated member is oriented perpendicularly to said center leg, the method comprising the following steps:

assembling a coil of electrically conducting wire around the center leg of the first laminated member;

orienting the second laminated member perpendicularly to the center leg of the first with at least portions of the oblique surfaces of the laminated members in physical contact to form a magnetic circuit with an air gap;

reducing said air gap by advancing the second laminated member toward the center leg of the first against the return force of the outer legs being bent resiliently outward by said contacting oblique surfaces while monitoring by means of said coil a physical parameter indicative of a desired magnetic or electrical characteristic or said core; and fixing said members permanently together when said parameter indicates the desired magnetic or electrical characteristic.

2. A method of making a laminated core for an ignition coil with an air gap, comprising the following steps:

making an E-shaped first laminated member having a pair of resiliently bendable outer legs with oblique surfaces on the inner free ends thereof and further having a shorter center leg, said oblique surfaces forming a first angle with a surface of said center leg which angle increases with outward bending of the outer legs;

assembling a coil of electrically conducting wire around said center leg;

making a bar shaped second laminated member having oblique surfaces on each end thereof, said oblique surfaces, when the second laminated member is oriented perpendicularly to the first, forming a second angle with said surface of the center leg of the first laminated member at least as great as the first angle through the total range of outward bending of the outer legs of the first laminated member achieved in the following steps;

orienting the second laminated member perpendicularly to the center leg of the first with at least portions of the oblique surfaces of the laminated members in physical contact to form a magnetic circuit with an air gap;

advancing the second laminated member toward the center leg of the first, to reduce said air gap, against the return force of the outer legs bent resiliently outward by said contacting oblique surfaces while monitoring, by means of said coil, a physical parameter indicative of a desired magnetic or electrical characteristic of the core; and fixing said members permanently together when said parameter indicates the desired magnetic or electrical characteristic.

* * * * *